US005277461A

United States Patent [19]

Dzurko et al.

[11] Patent Number: 5,277,461

[45] Date of Patent: Jan. 11, 1994

[54] VEHICLE DOOR LATCH

[75] Inventors: Thomas A. Dzurko, Mt. Clemens, Mich.; John F. Reelhorn, Pickerington, Ohio; Ronald P. Rimbey, Utica, Mich.

[73] Assignee: General Motors Corporation, Detroit, Mich.

[21] Appl. No.: 7,987

[22] Filed: Dec. 24, 1992

[51] Int. Cl.[5] ..... E05C 3/26

[52] U.S. Cl. ..... 292/216; 292/336.3; 292/DIG. 27

[58] Field of Search .....292/216, 280, DIG. 26, DIG. 27, 336.3, 201

[56] References Cited

U.S. PATENT DOCUMENTS

| | | | |
|---|---|---|---|
| 3,576,339 | 4/1971 | Grittner | 292/216 |
| 3,781,045 | 12/1973 | Watermann | 292/216 |
| 3,840,258 | 10/1974 | Brackmann | 292/216 |
| 3,844,596 | 10/1974 | Torii et al. | 292/216 |
| 4,634,156 | 1/1987 | Shimura et al. | 292/DIG. 26 X |
| 4,756,563 | 7/1988 | Garwood et al. | 292/216 |
| 5,054,827 | 10/1991 | Konchan et al. | 292/216 |

*Primary Examiner*—Richard E. Moore
*Attorney, Agent, or Firm*—Charles E. Leahy

[57] ABSTRACT

A vehicle door latch has a fork bolt lever that is latched by a detent lever. The detent lever is operated by an intermittent lever that is operated by a transfer lever that is actuated by inside and outside door handles via operating levers. The door latch includes with a locking lever that disconnects the door handles from the intermittent lever when it is in the locked position. The door latch also includes an interlock between the intermittent lever and the locking lever that is automatically engaged in response to the position of the detent so that the door latch cannot be locked when the fork bolt lever is in an unlatched position. Consequently the door latch can only be locked when the door is closed and the fork bolt lever is in a latched position. This prevents the driver from locking his or her keys in the vehicle.

15 Claims, 4 Drawing Sheets

VEHICLE DOOR LATCH

BACKGROUND OF THE INVENTION

This invention relates to vehicle door latches and more particularly to vehicle door latches that are capable of being locked from outside the vehicle.

Vehicle door latches customarily include a lock mechanism that prevents operation of the door latch so that the vehicle door cannot be opened by persons inside the vehicle unintentionally or by persons outside the vehicle who are not authorized. The door lock mechanism itself can also be operated from inside as well as from outside the vehicle.

The door lock mechanism is usually operated from inside the vehicle by a slide or a sill button that is actuated manually and also electrically in upscale vehicles. The door lock mechanism is usually operated from outside the vehicle by a key and key lock cylinder or some other device that keeps intruders locked out of the vehicle.

A long standing problem associated with lockable vehicle door latches is that of locking the keys inside the vehicle. This problem results from the door latch having the capability of being locked when it is unlatched. Thus the driver or passenger can lock the door by actuating the inside lock operator before the door is shut and avoid the inconvenience of using a key. Various solutions have been proposed for this "keyless" locking problem.

There are generally two types of mechanisms for locking the vehicle door latch. In one type, a locking member blocks and/or immobilizes a member of the latch mechanism so that the inside and outside door handles as well as the internal parts of the door latch cannot be moved.

One solution for the keyless locking problem in these blocking type door lock mechanisms is disclosed in U.S. Pat. No. 3,781,045 granted to Hans-Dieter Watermann Dec. 25, 1973 for a motor vehicle door latch with a lock mechanism that is only actuatable with the vehicle door closed. This known door latch has a detent or keeper that carries a fixed crank arm. The crank arm has a projection that prevents the lock mechanism from being engaged in all but the closed position of the door to prevent the user from locking his or her keys in the vehicle.

The second type of mechanism for locking the door latch is generally known as the free wheeling type. In this type, the lock mechanism disconnects the latching mechanism when it is engaged so that the motion of neither door handles is transferred to the detent lever and consequently operation of the door handles is ineffective. A vehicle door latch of this type is disclosed in U.S. Pat. No. 4,756,563 granted to Stephen L. Garwood and Jeffrey L. Konchan Jul. 12, 1988 for a vehicle door latch.

Solutions have also been proposed for the keyless locking problem in connection with vehicle door latches that have freewheeling type lock mechanisms. See for example U.S. Pat. No. 3,840,258 granted to Horst Brackmann Oct. 8, 1984 for a motor vehicle door latch and U.S. Pat. No. 5,054,827 granted to Jeffrey L. Konchan and Jiri Paulik Oct. 8, 1991 for a vehicle door latch.

These solutions, however do not prevent keyless door locking. They merely require actuation of the outside door handle or other outside latch operator with the hope that this extra operation will prevent unintentional locking of the keys in the vehicle.

SUMMARY OF THE INVENTION

The object of this invention is to provide a vehicle door latch that has a freewheeling type lock mechanism that simply cannot be engaged when the door latch is unlatched under any circumstances so that the vehicle user cannot lock his or her keys in the vehicle.

A feature of the vehicle door latch of the invention is that the door latch has an interlock mechanism that is automatically actuated in response to the position of the fork bolt lever to prevent engagement of the lock mechanism when door latch is unlatched.

Another feature of the vehicle door latch of the invention is that the vehicle door latch has a fork bolt lever that automatically actuates an interlock between a member of the latching mechanism and a member of lock mechanism when the fork bolt lever is in an unlatched position so that the locking mechanism cannot be engaged when the door latch in unlatched.

Still another feature of the invention is that the invention is that the vehicle door latch has a freewheel type lock mechanism and an interlock mechanism that is automatically engaged when the vehicle door latch is unlatched and that cannot be disengaged when the vehicle door latch is unlatched so that keyless locking is not possible.

BRIEF DESCRIPTION OF THE DRAWINGS

The above and other objects, features and advantages of the invention will become more apparent from the following description taken in conjunction with the accompanying drawing% wherein like references refer to like parts and wherein.

DESCRIPTION OF THE INVENTION

Figure 5:
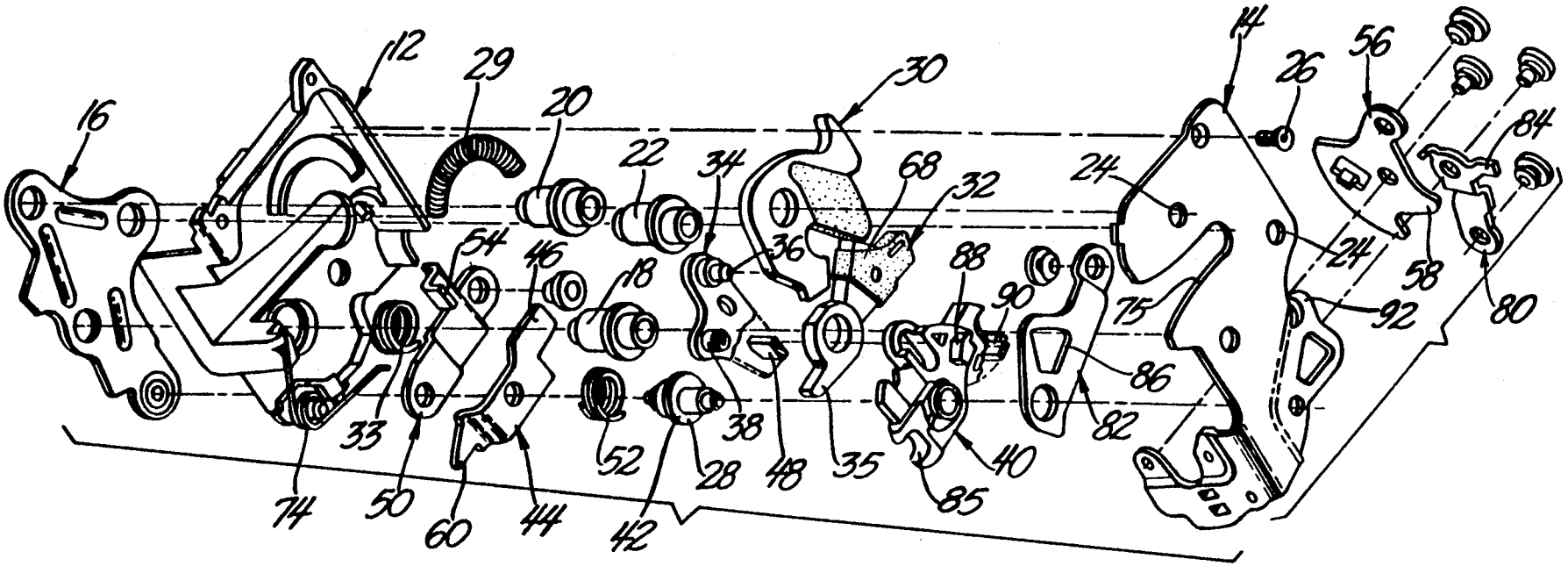
FIG. 5 is an exploded perspective view of the vehicle door latch that is shown in FIGS. 1–4.

Referring now to the drawing and more particularly to the exploded perspective view of FIG. 5, the vehicle door latch 10 is the same basic arrangement as the vehicle door latches that are disclosed in U.S. Pat. No. 4,756,563 granted to Stephen L. Garwood and Jeffrey Konchan Jul. 12, 1988 for a vehicle door latch and U.S. Pat. No. 5,054,827 granted to Jeffrey L. Konchan and Jiri Paulik Oct. 8, 1991 for a vehicle door latch, both of which are hereby incorporated in this patent specification by reference.

Figure 2:
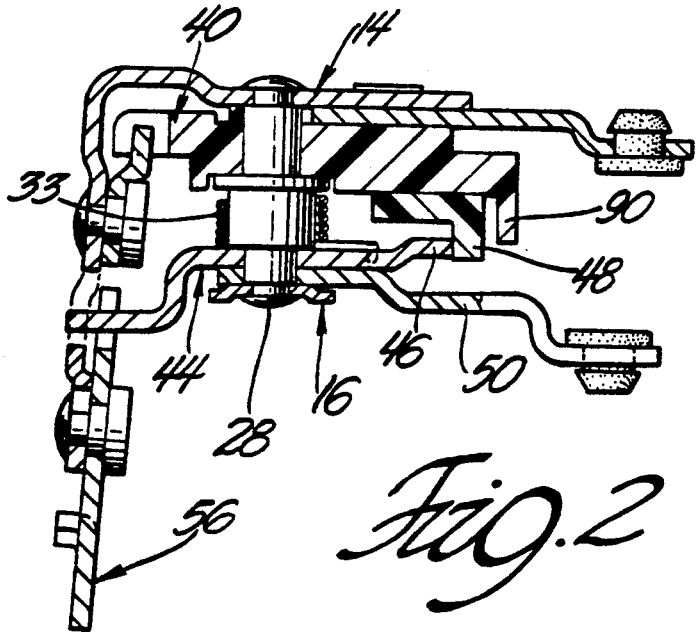
FIG. 2 is section taken substantially along the line 2—2 of FIG. 1 looking in the direction of the arrows.

The vehicle door latch 10 has a three piece enclosure that comprises plastic housing 12, metal face plate 14 and metal back plate 16. The plastic housing 12 and the metal back plate 16 are held together by three flanged, internally threaded bushings 18, 20 and 22 that are inserted into three holes in the plastic housing 12, then through three aligned holes in the back plate 16 and then flanged over the back plate. The metal face plate 14 has three bolt holes 24 that are aligned with the bushings 18, 20 and 24 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened on headed over as best shown in FIG. 2.

LATCHING MECHANISM

Figure 1:
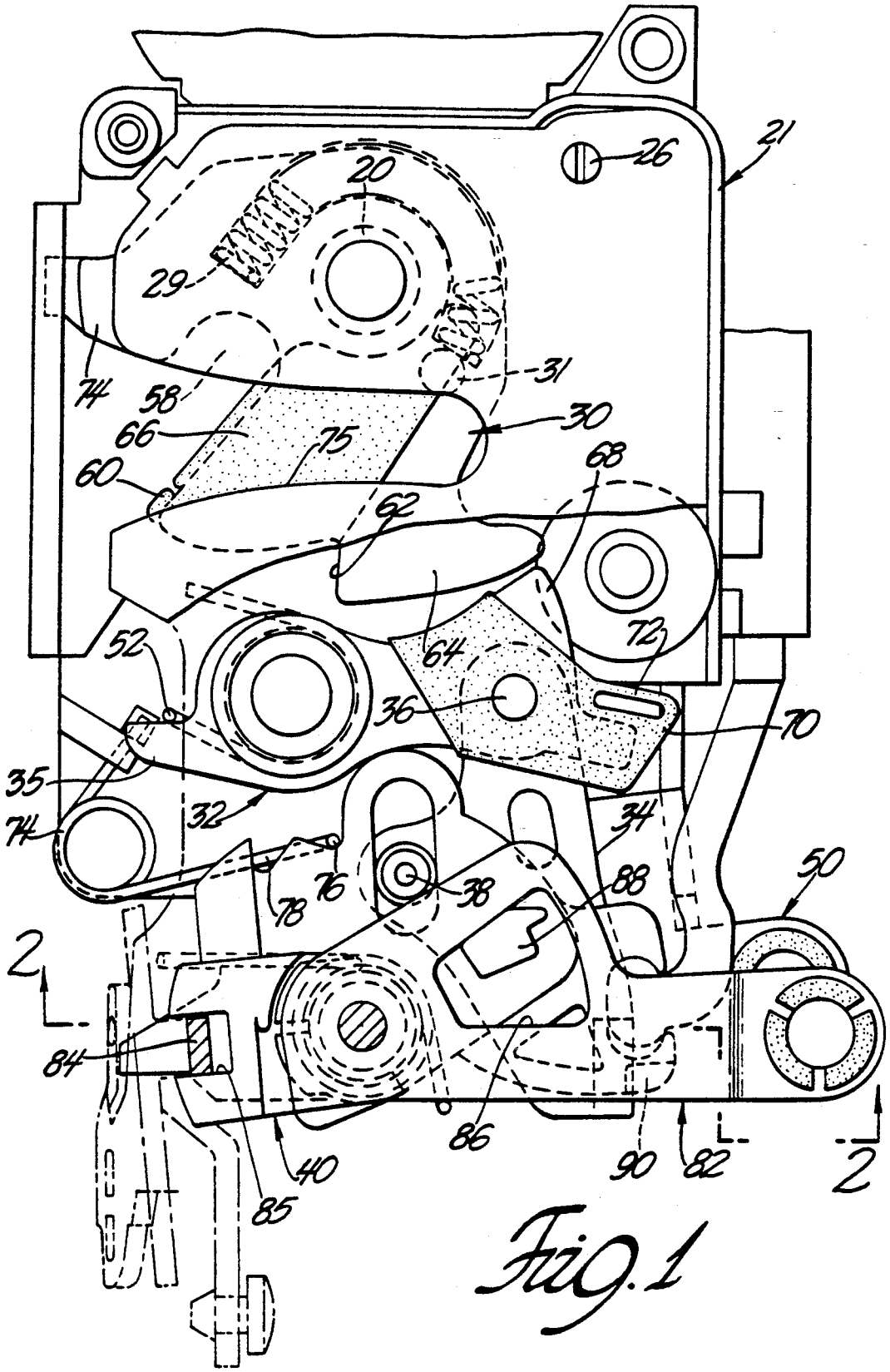
FIG. 1 is a front view of a vehicle door latch in accordance with the invention. The vehicle door latch is shown in an unlatched and unlocked condition.
Figure 3:
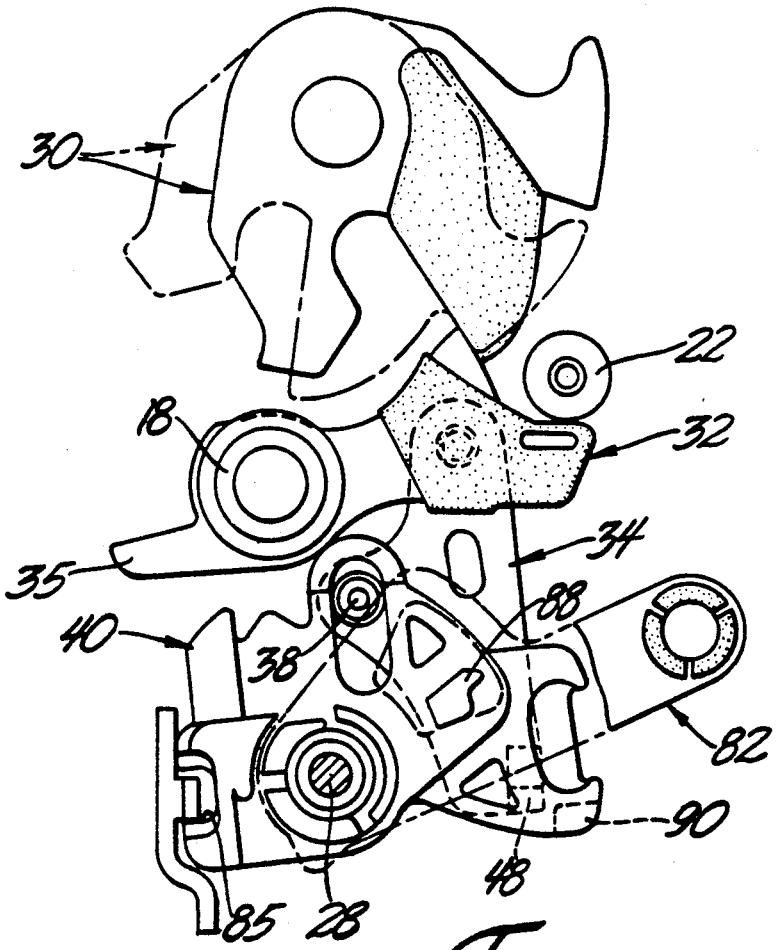
FIG. 3 is a fragmentary front view of the vehicle door latch of FIG. 1 showing parts of the vehicle door latch in full and intermediate latched positions.
Figure 4:
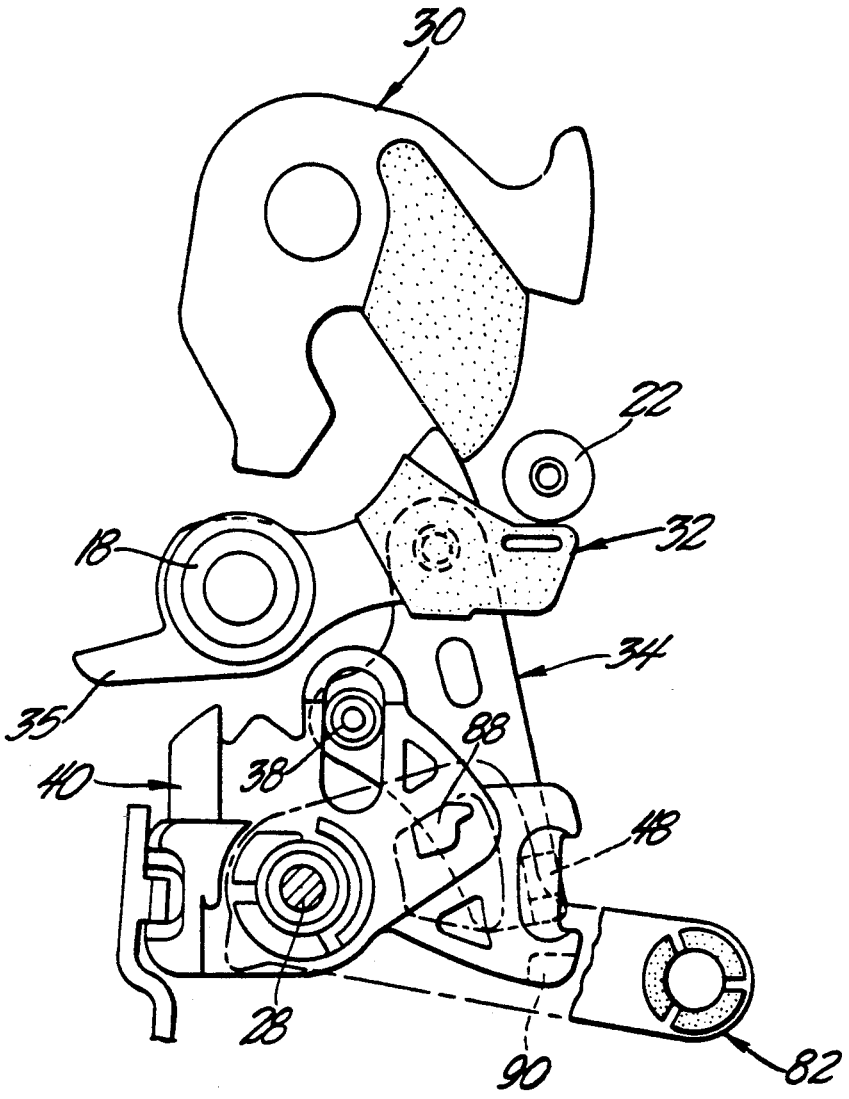
FIG. 4 is a fragmentary front view of the vehicle door latch of FIG. 1 showing parts of the vehicle door latch in an unlatched and locked condition.

The latching mechanism of the vehicle door latch 10 comprises a fork bolt lever 30 and a cooperating detent lever 32 that are pivotally mounted on bushings 20 and 18 respectively and located in a chamber of the plastic housing 12 behind the metal face plate 14. The fork bolt lever 30 is biased clockwise by a coil spring 29. The coil spring 29 is disposed in a curved slot in the plastic housing 12 behind the fork bolt lever 30 and it engages a depending pin 31 of the fork bolt lever 30 at one end. The detent lever 32 is biased counterclockwise into engagement with the fork bolt lever 30 by a coil spring 33 that surrounds the bushing 18 and that has one end engaging the plastic housing 21 and the other end engaging an ear 35 of the detent lever 32. The detent lever 32 engages the fork bolt lever 30 in its unlatched position as shown in FIG. 1 and engages and the holds the fork bolt lever 30 in intermediate and full latched positions against the bias of spring 29 as shown in FIGS. 3 and 4. The operation is explained more fully below.

The latching mechanism further comprises an intermittent lever 34 for operating the detent lever 32. The intermittent lever 34 is located in the chamber of the plastic housing 12 behind the detent lever 32. It has two integral pivot pins 36 and 38. Pivot pin 36 is journalled in a hole in the detent lever 32 so that the detent lever 32 rotates clockwise from the position shown in FIG. 3 (and out of latched engagement with the fork bolt lever 30) to the position shown in FIG. 1 when the intermittent lever 34 is pulled down. The pivot pin 38 is disposed in a slot of a locking lever 40 so that the locking lever 40 pivots the intermittent lever 34 counterclockwise about pivot pin 36 when the locking lever 40 is rotated clockwise from their respective positions shown in FIG. 3 to their respective positions shown in FIG. 4. The locking lever 40 is journalled on the stud 28 between the flange 42 and the face plate 14. The operation of the locking lever 40 is explained in greater detail below in connection with the description of the lock mechanism.

The latching mechanism further comprises a transfer lever 44 that is journalled on a reduced diameter portion of the stud 28 spaced rearwardly of the flange 42. The transfer lever 44 has an ear 46 at one end that is engagable with an integral, rearwardly projecting tab 48 of the intermittent lever 34 so that the intermittent lever 34 is pulled down when the transfer lever 44 is rotated clockwise as viewed in FIG. 5.

The latching mechanism further comprises an outside operating lever 50 and a coil return spring 52. The outside operating lever 50 is also journalled on the reduced diameter portion of the stud 28 behind the transfer lever 44. It has a bent tab 54 that engages the ear 46 of the transfer lever 44 so that the outside operating lever 50 rotates the transfer lever 44 clockwise when it is rotated clockwise on stud 28. The outside operating lever 50 is connected by suitable linkage for rotation by an outside door handle (not shown).

The coil return spring 52 is disposed around the stud 28 and located between the flange 42 and the transfer lever 44. One end of the coil spring 52 engages the bottom of transfer lever 44 and the other end engages the bottom of the plastic housing 12 above the transfer lever 44 so that the transfer lever 44 and outside operating lever 50 are biased counterclockwise to a rest position where tab 54 engages the bottom of the plastic housing 12.

The latching mechanism further comprises an inside operating lever 56 that is pivotally mounted on a flange of the metal face plate 14. The inside operating lever 56 has a tab 58 that engages a second ear 60 of the transfer lever 44 so that the inside operating lever also rotates the transfer lever 44 clockwise when it is rotated counterclockwise. The inside operating lever 56 is connected by suitable linkage for rotation by an inside door handle (not shown).

Referring now to FIG. 1, the fork bolt lever 30 has a conventional slot or throat 58 for receiving and retaining a striker member, such as that shown in the U.S. patents discussed above, that is attached to the door pillar to latch the door in the closed position (not shown). The fork bolt lever 30 also includes a primary latch shoulder 60, an intermediate latch shoulder 62 and a radially projecting foot 64. The fork bolt lever 30 also has a plastic coating 66 that covers a surface of the slot 58 that is engaged by the striker for energy absorption and quiet operation when the vehicle door is slammed shut.

The detent lever 32 has a sector shaped catch 68 that engages the radially projecting foot 64 when the fork bolt lever 30 is in the unlatched position as shown in FIG. 1. The sector shaped catch positively engages the primary and intermediate latch shoulders 60 and 60 to hold the fork bolt lever 30 in either full or intermediate latched positions shown in FIGS. 3 and 4 in solid line and phantom respectively. The detent lever 32 also includes a plastic coating 70 which has a slotted portion that provides an integral bumper 72. The bumper 72 engages the bushing 22 to stop counterclockwise pivoting of the detent lever 32 under the bias of spring 52. This bumper 72 also absorbs energy and quiets operation when the door is slammed shut.

The latching mechanism operates as follows. When the door latch 10 in an unlatched and unlocked condition as shown in FIG. 1, the fork bolt lever 30 is poised to receive a conventional striker (not shown) that projects into aligned fishmouth slots 74 and 75 of the plastic housing 12 and the metal face plate 14 when the door is shut. The entering striker engages the plastic coating 66 at the back of the throat 58 and rotates the fork bolt lever 30 counterclockwise against the bias of spring 29 until the fork bolt lever 30 is rotated to the full latch position shown in solid line in FIG. 3 where the fork bolt lever 30 captures the striker in the throat 58. The fork bolt lever 30 is held in the full latch position by the catch 68 of the detent lever 32 engaging the primary latch shoulder 60 of the fork bolt lever 30.

The catch 68 rides along the periphery of the fork bolt lever 30 under the bias of spring 52 as the fork bolt lever 30 rotates counterclockwise from the unlatched position shown in FIG. 1 to the full latch position shown in FIG. 3. During this travel, the catch 68 rides under the foot 64 into engagement with the intermediate latching shoulder 62 and then under the coated portion into engagement with the primary latching shoulder 60. It is to be noted that the engagement of the catch 68 with the intermediate latching shoulder 62 is sufficient to hold the vehicle door closed in the event that the vehicle door is shut completely so that the catch 68 engages the primary latch shoulder 60.

The vehicle door latch 10 is unlatched so that the vehicle door can be opened by operating either the inside or the outside door handle to rotate the transfer lever 60 clockwise and the ear 46 down as viewed in FIG. 5. The ear 46 engages projection 48 of intermittent lever 34 as shown in FIG. 2 and pulls the intermittent lever down from the full latch position shown in FIG. 3 to the unlatch position shown in FIG. 1. As the intermittent lever 34 is pull down, it rotates the detent lever 68 clockwise against the bias of spring 52 from the latch position shown in FIG. 3 to the unlatch position shown in FIG. 1. The fork bolt lever 30 is then free to rotate counterclockwise under the bias of spring 29 from the full latch position shown in solid line in FIG. 3 to the unlatch position shown in FIG. 1 as the striker is pulled out of the aligned fishmouth slots 74 and 75 when the vehicle door is opened.

LOCKING MECHANISM

Returning to FIG. 5, the vehicle door latch 10 includes a freewheeling type lock mechanism for disconnecting the latching mechanism so that operation of either the inside door handle or the outside door handle is ineffective in unlatching the detent liner 32. The lock mechanism comprises the locking lever 40 that is pivotally mounted on the stud 28 between the flange 42 and the metal face plate 14. As indicated above, the locking lever 40 is also connected to the intermittent lever 34 by a pin and slot arrangement that allows these two parts to translate and pivot with respect to each other.

The locking lever 40 pivots on the stud 29 between an unlocked position shown in FIGS. 1, 2 and 3 and a locked position shown in FIG. 4. The locking lever 40 is held in the unlocked position by a coil spring 74 that has one end mounted on the plastic housing 12 and the other end engaging a first detent notch 76 in the plastic locking lever 40. The plastic locking lever 40 pivots clockwise from this position to the locked position shown in FIG. 4. The end of the coil spring 74 engages a second detent notch 78 in the locking lever 40 to hold it in the locked position.

The lock mechanism further comprises inside and outside lock operating levers 80 and 82 for pivoting the plastic locking lever 40 back and forth between the locked and unlocked positions. The inside lock operating lever 80 is pivotally mounted on the flange of the metal face plate 14 in front of the inside operating lever 56 for unlatching the door. It includes a tab 84 that engages in a slot 85 in one end of the plastic locking lever 40 so that the plastic locking lever 40 is pivoted clockwise from the unlocked position shown in FIG. 3 to the locked position shown in FIG. 4 when the inside locking lever 80 is pivoted counterclockwise by an inside door handle or slide (not shown).

The outside lock operating lever 82 is pivotally mounted on the stud 28 between the locking lever 40 and the face plate 14. The outside lock operating lever 82 has a sector shaped cut-out 86 that receives an integral projection 88 of the locking lever 40. This forms a lost motion connection between the outside lock operating lever 82 and the locking lever 40 so that the key and key cylinder can be returned to a so that the key and key cylinder can be returned to a neutral position after the locking lever 40 is rotated one way or the other. In any event, the locking lever 40 can also be rotated clockwise from the unlocked position shown in FIG. 3 to the locked position shown in FIG. 4 by rotating the outside lock operating lever 82 clockwise from the unlocked position shown in FIG. 3 to the locked position shown in FIG. 4 and back through suitable linkage by a conventional key lock cylinder (not shown).

The lock mechanism operates as follows. When the vehicle door latch 10 in a latched condition as shown in FIG. 3. The lock mechanism is actuated by rotating the locking lever 40 clockwise from the unlocked position shown in FIG. 3 to the locked position shown in FIG. 4. As indicated above this can be accomplished through rotation of the inside lock operating lever 80 by an inside sill button or lock slide or by rotation of the outside lock operating lever 82 by turning a key in the key lock cylinder. Clockwise rotation of the locking lever 40 also rotates the intermittent lever 34 counterclockwise about the pivot pin 36 that is journalled in the detent lever 32 due to the engagement of the second pivot pin 38 of the intermittent lever 34 in the slot of the locking lever 40. The intermittent lever 34 is rotated counterclockwise from the unlocked position shown in FIG. 3 to the locked position shown in FIG. 4 moving the projection 48 out from under the ear 46 of the transfer lever 46. Consequently when the door handles are operated so as to rotate the transfer lever 44 clockwise to the unlatching position, the ear 46 simply bypasses the projection 48 without transferring any motion to the intermittent lever 34. In other words the transfer lever 44 simply free wheels so that operation of the door handles is ineffective.

The lock mechanism is unlocked simply by rotating the locking lever 40 counterclockwise back to the unlocked position shown in FIG. 3 where the projection 48 is beneath the ear 46 of the transfer lever 44 so that clockwise rotation of the transfer lever 44 pulls the intermittent lever 34 and the detent lever 32 down to the disengaged position shown in FIG. 1.

INTERLOCK MECHANISM

The vehicle door latch 10 also includes an interlock mechanism that permits the vehicle door latch 10 to be locked when the door latch is in a latched condition as shown in FIG. 3 but which does not permit the vehicle door latch 10 to a locked when the door latch 10 is in an unlatched condition as shown in FIG. 1.

The interlock mechanism comprises the fork bolt lever 30 which has the radially projecting foot 64, the detent lever 32 that is spring biased into engagement with the fork bolt lever 30, the intermittent lever 34 that is pivoted on and positioned by the detent lever 32, the locking lever 40 that is connected to the intermittent lever 34 by an arrangement that allows these two parts to translate and pivot with respect to each other, and an integral interlock projection 90 of the locking lever 40 that limits pivotal movement of the intermittent lever 34 with respect to the locking lever 40 in certain circumstances.

The integral interlock projection 90 which is best shown in FIGS. 2 and 5 is positioned at the bottom right hand side of the locking lever 40 as shown in FIGS. 1, 3 and 4. In such a position, the integral interlock projection 90 is located out of the path of movement of the intermittent lever 34 when the door latch 10 is in a latched condition and the lock lever 40 is actuated.

Returning now to FIG. 3, the door latch 10 is shown in a latched and unlocked condition. In this condition, the detent lever 32 is biased against the bushing 22 by the coil spring 33 locating the pivot hole for the pivot pin 36 of the intermittent lever 34. In this instance the intermittent lever 34 is in an upper position in the housing 12 that can be noted from the high position of the second pivot pin 38 of the intermittent lever 34 in the slot of the locking lever 40. In this upper position, the intermittent lever 34 bypasses the interlock projection 90 as it pivots from the unlocked position shown in FIG. 3 to the locked position shown in FIG. 4. In other words, the interlock projection 90 is out of the path of movement of the intermittent lever 34 as it pivots relative to the detent lever 32 and moves relative to the locking lever 40 so as to move from the unlocked position of FIG. 3 to the locked position of FIG. 4.

On the other hand, this same lock projection 90 prevents actuation of the locking mechanism when the fork bolt lever 30 is in an unlatched condition as shown in FIG. 1. In this unlatched condition, the foot 64 of the fork bolt lever 30 holds the detent lever 32 in an unlatched position shown in FIG. 1 where the detent 32 is rotated clockwise from the latched position shown in FIG. 3. This lowers the pivot hole for the pivot pin 36 and lowers the intermittent lever 34 in the housing 12 as shown by the low position of the second pivot pin 38 in the slot of the locking lever 40. The lower end of the intermittent lever 34 is now located adjacent the interlock projection 90 due to the lower positioning of the intermittent lever 34 in the housing 12 by the detent lever 32 and foot 64 of the fork bolt lever 30. Consequently, the locking mechanism cannot be actuated because the lock projection 90 interferes and locks up the intermittent lever 34 and the locking lever 40 in response to clockwise rotation of the locking lever 40. In other words the interlock projection 90 is now located in the path of movement of the intermittent lever 34.

Moreover the interlock mechanism that is automatically engaged by the unlatched position of the fork bolt 30 cannot be disengaged by operating the inside or the outside operating levers 56 and 50 that are connected to the door handles or similar operators, because the transfer lever 44 cannot raise the intermittent lever 34 above the projection 90.

While the interlock projection 90 is illustrated as being an integral part of the locking lever 40 that interferes with movement of the intermittent lever 34 to the locked position in certain circumstances, it is also conceivable that the interlock projection 90 can be made an integral part of the intermittent lever 34 that interferes with movement of the locking lever 40 to the locked position. In other words, the invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A vehicle door latch having a free wheel lock mechanism and an interlock mechanism that prevents engagement of the free wheel lock mechanism when the vehicle door latch is in an unlatched condition comprising;

a fork bolt that is moveable between a latched position and an unlatched position, the fork bolt having a latch shoulder that is engaged by a detent to hold it in the latched position and a conformation that engages and repositions the detent when it is in the unlatched position, an intermittent member that is positioned by the detent and operatively connected to the detent for disengaging the detent from the latch shoulder of the fork bolt, a moveable locking member that is moveable relative to the intermittent member and operatively connected to the intermittent lever for moving the intermittent member between an unlocked position and a locked position, and an interlock conformation on one of the intermittent member and the locking member that limits movement of the intermittent member relative to the locking member when the detent engages the conformation of the fork bolt so that the locking member cannot move the intermittent member to the locked position when the fork bolt is in the unlatched position.

2. The vehicle door latch as defined in claim 1 wherein the interlock conformation is located on the locking member so that it is out of the path of movement of the intermittent member when the detent engages the latch shoulder of the fork bolt.

3. The vehicle door latch as defined in claim 1 wherein the detent locates the intermittent member in an upper position with respect to the locking member when the detent engages the latch shoulder of the fork bolt so that the interlock conformation is bypassed as the intermittent member moves from an unlocked position to a locked position.

4. A vehicle door latch having a free wheel lock mechanism and an interlock mechanism that prevents engagement of the free wheel lock mechanism when the vehicle door latch is in an unlatched condition comprising;

a fork bolt lever that is rotatable between a latched position and an unlatched position and that has a radially projecting foot, a detent lever that is rotatable between a first position holding the fork bolt lever in the latched position and a second position engaging the radially projecting foot of the fork bolt lever when the fork bolt lever is in the unlatched position, an intermittent lever that is pivoted on and positioned by the detent lever, a locking lever that is rotatable between an unlocked position and a locked position and that is connected to the intermittent lever by an arrangement that allows these two parts to translate and pivot with respect to each other, and an integral interlock projection on one of the intermittent lever and the locking lever that limits movement of the intermittent lever with respect to the locking lever when the detent lever is in the second position so that the locking lever cannot be rotated to the locked position when the fork bolt lever is in the unlatched position.

5. The vehicle door latch as defined in claim 4 wherein the integral interlock projection is located on the locking lever so that it is out of the path of movement of the intermittent lever when the detent lever is in the first position.

6. The vehicle door latch as defined in claim 4 wherein the detent lever locates the intermittent lever in an upper position with respect to the locking lever when the detent lever is in the first position so that the interlock projection is bypassed as the locking lever rotates from an unlocked position to a locked position.

7. The vehicle door latch as defined in claim 4 wherein the interlock projection is out of the path of movement of the intermittent lever as it pivots relative to the detent lever and moves relative to the locking lever to move from an unlocked position to a locked position.

8. A vehicle door latch having a free wheel lock mechanism and an interlock mechanism that prevents engagement of the free wheel lock mechanism when the vehicle door latch is in an unlatched condition comprising;

a fork bolt lever that is rotatable between a latched position and an unlatched position and that has a radially projecting foot, a detent lever that is rotatable between a first position holding the fork bolt lever in the latched position and a second position engaging the radially projecting foot of the fork bolt lever when the fork bolt lever is in the unlatched position, an intermittent lever that is pivoted on and positioned by the detent lever, a locking lever that is rotatable between an unlocked position and a locked position and that is connected to the intermittent lever by an arrangement that allows these two parts to translate and pivot with respect to each other, the intermittent lever being lowered with respect to the locking lever by the detent lever when the detent lever rotates from the first position to the second position, and an integral interlock projection on one of the intermittent lever and the locking lever that limits movement of the intermittent lever with respect to the locking lever when the detent lever is in the second position so that the locking lever cannot be rotated to the locked position when the fork bolt lever is in the unlatched position.

9. The vehicle door latch as defined in claim 8 wherein the integral interlock projection is located on the locking lever so that it is out of the path of movement of the intermittent lever when the detent lever is in the first position.

10. The vehicle door latch as defined in claim 8 wherein the detent lever locates the intermittent lever is in an upper position with respect to the locking lever when the detent lever is in the first position so that the interlock projection is bypassed as the locking lever rotates from an unlocked position to a locked position.

11. The vehicle door latch as defined in claim 8 wherein the interlock projection is out of the path of movement of the intermittent lever as it pivots relative to the detent lever and moves relative to the locking lever to move from an unlocked position to a locked position.

12. The vehicle door latch as defined in claim 8 wherein the foot of the fork bolt lever holds the detent lever in an unlatched position rotated clockwise from the latched position.

13. The vehicle door latch as defined in claim 8 wherein the lock projection is on the locking lever and the lower end of the intermittent lever is located adjacent the interlock projection when the intermittent lever is lowered with respect to the locking lever by the detent lever when the detent lever rotates from the first position to the second position.

14. The vehicle door latch as defined in claim 8 wherein the lock projection interferes with and locks up the intermittent lever and the locking lever in response to clockwise rotation of the locking lever.

15. The vehicle door latch as defined in claim 8 wherein the interlock projection is on the locking lever and located in the path of movement of the intermittent lever.

* * * * *